United States Patent [19]

Inoue et al.

[11] Patent Number: 4,983,509

[45] Date of Patent: Jan. 8, 1991

[54] SILVER HALIDE PHOTOGRAPHIC MATERIAL

[75] Inventors: Nobuaki Inoue; Tetsuo Yoshida, both of Kanagawa, Japan

[73] Assignee: Fuji Photo Film Co., Ltd., Kanagawa, Japan

[21] Appl. No.: 367,294

[22] Filed: Jun. 15, 1989

[30] Foreign Application Priority Data

Jun. 15, 1988 [JP] Japan ..... 63-147337
Jun. 15, 1988 [JP] Japan ..... 63-147338

[51] Int. Cl.[5] ..... G03C 1/04

[52] U.S. Cl. ..... 430/627; 430/567; 430/569; 430/628

[58] Field of Search ..... 430/627, 628, 567, 569

[56] References Cited

U.S. PATENT DOCUMENTS 4,588,678 5/1986 Ikeda ..... 430/420
4,826,758 5/1989 Yoshida et al. ..... 430/569

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A silver halide photographic material is disclosed, comprising a support having thereon at least one hydrophilic colloid layer at least one of which must be a gold- and sulfur-sensitized silver halide emulsion layer, said silver halide emulsion layer containing from 0.1 to 3.0 mol % silver iodide per mol of silver, wherein said silver halide emulsion comprises silver halide grains having a substantial core/shell structure wherein the silver iodide content in the shell is less than that in the core, and the silver halide emulsion layer or other hydrophilic colloid layer contains a polymer represented by the formula (I)

$$-(A)_x(B)_y(C)_z- \qquad (I)$$

wherein A represents a recurring monomer unit derived from an ethylenically unsaturated monocarboxylic acid or a monocarboxylate thereof, capable of copolymerization with an ethylenically unsaturated monomer; B represents a recurring unit derived from a polyfunctional crosslinking agent; C represents a recurring unit of an ethylenically unsaturated monomer, other than A or B; x represents the number of recurring units A having a mole fraction of from 30 mol % to 100 mol %; y represents the number of recurring units B having a mole fraction of from 0 to 50 mol %; and z represents the number of recurring units C having a mole fraction of from 0 to 50 mol %.

9 Claims, No Drawings

SILVER HALIDE PHOTOGRAPHIC MATERIAL

FIELD OF THE INVENTION

This invention relates to a silver halide photographic material and, more particularly, to a silver halide photographic material having a high sensitivity when exposed to a high intensity light source for a short exposure time and having excellent pressure resistance.

BACKGROUND OF THE INVENTION

Recently, a scanner system has been widely used in the manufacture of printing plates. For forming images using the scanner system, various recording apparatus are employed. Recording light sources for these scanner system recording apparatus include a glow lamp, a xenon lamp, a tungsten lamp, a light emitting diode (LED), a He-Ne laser, an argon laser, a semiconductor laser, etc.

Newly developed scanner systems employ a dot generator based system of directly, by electrical means, forming dots or characters. As the scanner light source for the dot generator system, a high output argon laser had hitherto been used. However, since the above light source is bulky and expensive, dot generator system recording apparatus using a He-Ne laser light source (632.8 nm) or an LED light source (660 to 650 nm), which are more compact and inexpensive, have recently been developed. The light-sensitive materials for use in the scanner apparatus require certain characteristics. In particular, the light-sensitive material must have a high spectral sensitivity for each wavelength of the scanner light source and must also have a high sensitivity and a high contrast even when exposed with a high illuminance source and for a short exposure time of from $10^{-3}$ to $10^{-7}$ seconds. The above conditions are typically employed in a scanner recording apparatus. Furthermore, in the field of facsimile, the light-sensitive material must be able to endure high-temperature fast processing for quick reporting and must also be able to be handled in a bright green safelight in order to allow for efficient operation. With the increase in scanning speed, the increase of line density for improving the image quality, and the sharpening of the scanning light beam, the development of a light-sensitive material having a higher sensitivity and a higher contrast has been strongly desired.

In order for the light-sensitive material to have a high sensitivity and a high contrast under conditions of high illuminace and short exposure times of from $10^{-3}$ to $10^{-7}$ seconds using an LED light source or a He-Ne laser light source, the sensitivity of the silver halide emulsion or the spectral sensitivity of a silver halide emulsion thus sensitized must be high at the above conditions. A method frequently used for this purpose involves increasing the sensitivity of the silver halide emulsion by introducing an iridium salt into the silver halide as described in JP-A-48-60918, JP-A-58-211753, JP-A-61-29837, and JP-A-61 201233 (the term "JP-A" as used herein means an "unexamined published Japanese patent application") and JP B-48-42172 (the term "JP-B" as used herein means an "examined Japanese patent publication"). Also, spectral sensitizing dyes for generally obtaining red-sensitive silver halide emulsions are described in JP-B-48-42172 and JP-B-55-39818 and JP-A-50-62425 and JP-A-54-18726.

Preferred silver halide emulsions for red-sensitive emulsions comprise mono-dispersed gold- and sulfur-sensitized silver iodobromide emulsions having a cubic or tetradecahedral crystal habit as described in JP-B-52-21366 and Japanese Patent Application Nos. 63-16256 and 63-64119.

Such high-sensitive emulsions may have a high sensitivity and a high contrast to practical light exposure but, on the other hand, have a reduced pressure resistance and, in particular, fog due to pressure is liable to occur.

Also, silver halide grains having a core/shell structure have hitherto been developed for increasing the sensitivity and improving the image quality by employing the development inibiting effect of iodide ions. These techniques are described in JP-A-59 188639, JP-A-59 177535, JP-A 59-181337, JP-A-59-192241, JP-A-60-11838, JP-A-60-138538, and JP-A-60-254032. Silver halide emulsions having a core/shell structure may be advantageous with respect to high sensitivity and pressure resistance, and in particular, fog due to pressure is reduced as compared with a silver halide emulsion having uniform structure grains, but the performance thereof has not yet been satisfactory.

Pressure is applied to light-sensitive materials in the manufacture thereof and when transporting and cutting the material. Also, pressure is unavoidably applied to the light-sensitive material in light exposure and development thereof.

When pressure is applied to a light-sensitive material, the pressure is applied to the silver halide grains through gelatin or other high molecular binder material. When pressure is applied to silver halide grains, blackening or desensitization can occur regardless of the exposure amount as reported, e.g., in K. B. Mather, *Journal of Optical Society of America,* 38, 1054 (1948) and P. Faelens, *Journal of Photographic Science,* 2, 105 (1954).

As a means for avoiding the change of density by the applied pressure, a method is known of cushioning the pressure before reaching silver halide grains by incorporating a polymer or a plasticizer in the silver halide emulsion, or by reducing the ratio of silver halide/gelatin in a particular silver halide emulsion layer or in the light-sensitive material.

In this regard, British Patent No. 738,618 discloses a method using a heterocyclic compound, British Patent No. 738,637 discloses a method using an alkyl phthalate, British Patent No. 738,639 discloses a method using an alkyl ester, U.S. Pat. No. 2,960,404 discloses a method using a polyhydric alcohol, U.S. Pat. No. 3,121,060 discloses a method using a carboxyalkyl cellulose, JP-A-49-5017 discloses a method using paraffin and a carboxylate, and JP-B-53-28086 discloses a method using an alkyl acrylate and an organic acid.

According to those methods using a plasticizer, however, the amount of plasticizer is limited so as not to reduce mechanical strength of the emulsion layer. On the other hand, when the ratio of silver halide/gelatin is increased, the resulting light-sensitive material has a low developing speed and loses the property for quick processing.

A polymer having an acid group is introduced into silver halide emulsion layers for various purposes and these techniques are disclosed, for example, in U.S. Pat. Nos. 3,062,674 and 3,287,289 and JP-A-61-228437, JP-A-62-55642, JP-A-62-220947, JP-A-62-222242, and JP-A-62-247351.

SUMMARY OF THE INVENTION

A first object of the present invention is to provide a photographic light-sensitive material having high sensitivity at a high illuminace light exposure.

A second object of the present invention is to provide a photographic light-sensitive material having excellent pressure resistance.

A third object of this invention is to provide a photographic light-sensitive material suitable for exposure by a LED light source or a He-Ne laser light source.

It has now been discovered that the aforesaid objects are attained by a silver halide photographic material having on a support at least one hydrophilic colloid layer at least one of which must be a gold- and sulfur-sensitized silver halide emulsion layer, said silver halide emulsion containing from 0.1 to 3.0 mol % silver iodide per mol of silver, wherein said silver halide emulsion comprises silver halide grains having a substantial core/shell structure wherein the silver iodide content in the shell is less than that in the core, and the silver halide emulsion layer or other hydrophilic colloid layer contains a polymer represented by the formula (I):

$$\sim(A)_x(B)_y(C)_z \qquad (I)$$

wherein A represents a recurring monomer unit derived from an ethylenically unsaturated monocarboxylic acid or a monocarboxylate thereof, capable of copolymerization with an ethylenically unsaturated monomer; B represents a recurring unit derived from a polyfunctional crosslinking agent; C represents a recurring unit of an ethylenically unsaturated monomer, other than A and B; x represents the number of recurring units A having a mole fraction of from 30 mol % to 100 mol %; y represents the number recurring unit B having a mole fraction of from 0 to 50 mol %; and z represents the number of recurring units C having a mole fraction of from 0 to 50 mol %.

DETAILED DESCRIPTION OF THE INVENTION

The invention is described in detail below.

The core/shell type silver halide grains for use in the present invention are composed of a core portion comprising a silver halide containing silver iodide and a shell portion covering the core portion, said shell portion having a silver iodide content less than that of the aforesaid core portion. The thickness of the shell portion is preferably from 0.01 μm to 0.3 μm, and more particularly from 0.05 μm to 0.2 μm. The silver iodide content of the aforesaid core portion is preferably from 1 mol % to 15 mol %, and more preferably from 3 mol % to 12 mol %, and the silver iodide content of the shell portion is preferably from 0 to 2 mol %, and more preferably from 0 to 1 mol %.

The silver halide of the present invention is preferably silver iodobromide but may contain silver chloride in an amount which does not impair the effect of the present invention.

The term "having a substantial core/shell structure" as used in the present invention includes a core structure that may be composed of two or more layers. When the core portion has at least two layers, at least one of the layers is composed of a silver halo-iodide having a silver iodide content higher than that of the shell (the outermost layer). In this case, it is preferred that the mean silver iodide content of the core portion is greater than the silver iodide content of the shell portion.

In the present invention, the difference in the silver iodide content between the core portion and the shell portion is preferably at least 3 mol %, and more preferably from 3 mol % to 5 mol %.

The mean silver iodide content of the whole silver halide grain is preferably from 0.1 mol % to 3.0 mol %, and, for quick processing, is particularly preferably from 0.5 mol % to 2.0 mol %.

The silver molar ratio of the shell portion to the core portion is preferably from 1/1 to 9/1, and particularly preferably from 3/1 to 5/1.

The structure of the silver halide grains for use in the present invention may be cubic, octahedral, tetradecahedral, tabular, spherical, etc., but a mono-dispersed silver halide emulsion containing cubic or tetradecahedral silver halide grains is preferred.

A mono-dispersed silver halide emulsion of the present invention means a silver halide emulsion composed of silver halide grains having a grain size distribution, the coefficient of variation as defined below of which is not more than 20%, and preferably not more than 15%.

$$\text{Coefficient of Variation } (\%) = A/B \times 100$$

A: Standard deviation of grain sizes

B: Mean value of grain sizes

The silver halide emulsions for use in the present invention can be prepared according to the methods described in P. Glafkides, *Chimie et Physique Photographique*, published by Paul Montel, (1967); G. F. Duffin, *Photographic Emulsion Chemistry*, published by Focal Press, (1966), and V. L. Zelikman et al., *Making and Coating Photographic Emulsion*, published by Focal Press, (1964).

That is, the emulsion can be prepared by an acid method, a neutralization method, an ammonia method, etc. For reacting a soluble silver salt and a soluble halide, a single jet method, a double jet method, or a combination thereof may be employed. A reverse mixing method of forming silver halide grains in the presence of excess silver ions can also be used. The controlled double jet method wherein a constant pAg is maintained in forming the silver halide grains can also be used. According to this method, a silver halide emulsion containing silver halide grains having a regular crystal form and a substantially uniform grain size can be obtained.

Also, for forming uniform silver halide grains, it is preferred to quickly grow the grains below critical saturation by adjusting the addition rates of the silver halide and the alkali metal halide according to the growth rate of the silver halide grains as described in British Patents No. 1,535,016 and JP-B-48-36890 and JP-B-52-16364 or by a method of changing the concentrations of the aqueous silver salt solution and the aqueous halide solution as described in U.S. Pat. No. 4,242,445 and JP-A-55-158124.

Furthermore, when using tabular silver halide grains in the photographic material of the present invention, silver halide grains having uniform grain size and/or uniform thickness are preferred as described in JP-B-47-11386, Japanese Patent Application No. 61-48950, and JP-A-63-151618.

The core/shell type silver halide grains of the present invention can be produced by a conventional manner, as described in, for ezample, JP-B-49-21657, JP-A-51-

39027, JP-A 54-118823, JP-A-58-108528, JP-A-59-29243, JP-A-59-52237, JP-A-59-74548, JP-A-59-116645, JP-A-59-149344.

It is preferred that a cadmium salt, a zinc salt, a lead salt, a thallium salt, an iridium salt or the complex salt thereof, a rhodium salt or the complex salt thereof, or an iron salt or the complex salt thereof be present in the step of forming or physically ripening the silver halide grains for use in the photographic material of the present invention.

In particular, the presence of an iridium salt increases sensitivity and contrast and enhances developability. The preferred addition amount of an iridium salt is in the range of from $1\times10^{-9}$ to $1\times10^{-6}$ mol per mol of silver. The aforesaid salt may be added to the core and/or the shell of the silver halide grains.

Silver halide solvents can be used in preparing the silver halide emulsions of the present invention. Examples of the silver halide solvent are the organic thioethers as described in U.S. Pat. Nos. 3,271,157, 3,531,289, and 3,574,628, thiourea derivatives as described in JP A 53-82408 and JP-A-55-77737, silver halide solvents having oxygen or a carbonyl group as described in JP-A-53-144319, and imidazoles, sulfates, and thiocyanates as described in JP-A 54-100717. Of these silver halide solvents, the thioethers are particularly preferred.

Specific examples of the thioether are as follows.

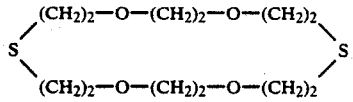

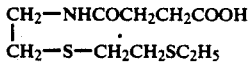

$$HO-(CH_2)_2-S-(CH_2)_2-S-(CH_2)_2-OH$$

The silver halide emulsion for use in the present invention must necessarily be subjected to gold sensitization and sulfur sensitization.

As the gold sensitizer of the silver halide emulsion of the present invention, various gold salts such as potassium aurochlorite, potassium auric thiocyanate, potassium chloroaurate, auric trichloride, etc., can be used. Specific examples thereof are described in U.S. Pat. Nos. 2,399,083 and 2,642,361.

As the sulfur sensitizer of the silver halide emulsion of the present invention, the sulfur compounds contained in gelatin and various sulfur compounds such as thiosulfates, thioureas, thiazoles, rhodanines, etc., may be used. Specific examples thereof are described in U.S. Pat. Nos. 1,574,944, 2,278,947, 2,410,689, 2,728,668, 3,501,313, and 3,656,955.

Preferred sulfur compounds are thiosulfates and thioureas.

The addition amount of each of the sulfur sensitizer and the gold sensitizer of the present invention is preferably from $10^{-7}$ mol to $10^{-2}$ mol, and more preferably from $1\times10^{-5}$ mol to $1\times10^{-3}$ mol per mol of silver.

Also, the ratio of the sulfur sensitizer to the gold sensitizer is from 1:3 to 3:1, and preferably from 1:2 to 2:1.

The silver halide grains for use in the present invention may further contain a complex salt of noble metals other than gold, such as platinum, palladium, iridium etc.

Furthermore, the silver halide emulsion for use in the present invention may be further sensitized by a reduction sensitizing method. As a reduction sensitizer, stannous salts, amines, formamidinesulfinic acid, silane compounds, etc., can be used.

The polymer (acid polymer) of the aforesaid formula (I) is described below in detail.

In formula (I), x represents a mole fraction of the recurring unit A of preferably from 40 mol % to 100 mol %, and more preferably from 50 mol % to 100 mol %.

Specific examples of the recurring unit A in formula (I) are as follows.

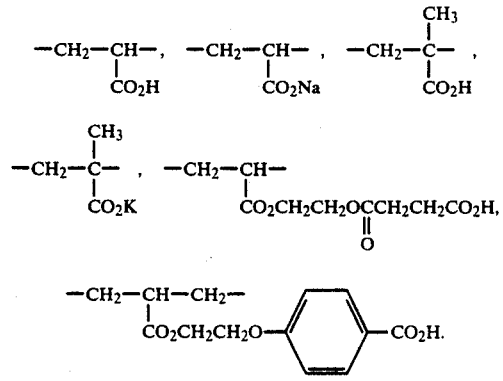

The recurring units A may also be derived from maleic acid and phthalic acid.

Examples of the polyfunctional crosslinking agent from which the recurring unit represented by B in formula (I) is derived are divinylbenzene, trivinylcyclohexane, trivinylbenzene, 2,3,5,6-tetrachloro-1,4-divinylbenzene, esters of unsaturated acids and unsaturated alcohols (e.g., vinyl crotonate, allyl methacrylate, and allyl crotonate), esters of unsaturated acids and polyfunctional alcohols (e.g., trimethylolpropane trimethacrylate, neopentyl glycol dimethacrylate, butanediol dimethacrylate, 1,6-hexanediol diacrylate, 1,5-pentanediol diacrylate, pentaerythritol triacrylate, tetraethylene glycol diacrylate, and triethylene glycol diacrylate), esters of unsaturated alcohols and polyfunctional acids (e.g., diethyl phthalate), unsaturated polyethers (e.g., triethylene glycol divinyl ether), water-soluble bisacrylamides (e.g., methylene-bisacrylamide, glyoxal-bisacrylamide, N,N'-dihydroxyethylene-bisacrylamide, N,N'-cystaminebisacrylamide, and triacryldiethylenetriamine), and acrylic acid (or methacrylic acid) esters of polyethers (e.g., polyethylene glycol diacrylate, polyethylene glycol dimethacrylate, and divinylsulfone).

Particularly preferred monomer components for B are divinylbenzene and diethylene glycol dimethacrylate.

Examples of the ethylenically unsaturated monomer for C in formula (I) are an alkyl acrylate, an alkyl methacrylate, ethylene, propylene, styrene, acrylamide, and methacrylamide.

Specific examples of the preferred acid polymer for use in this invention shown by formula (I) described above are illustrated below.

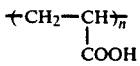

I-1

-continued

I-2

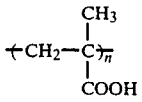

I-3

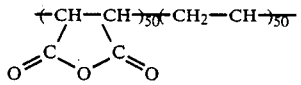

I-4

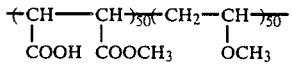

I-5

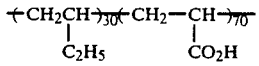

I-6

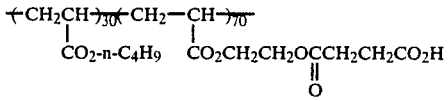

I-7

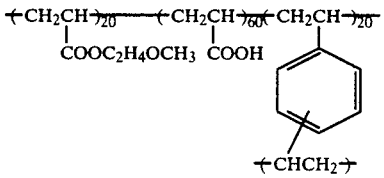

I-8

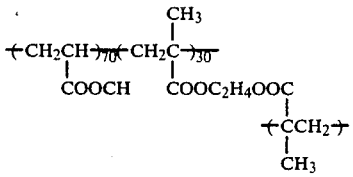

I-9

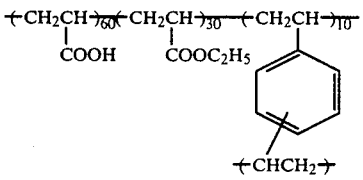

I-10

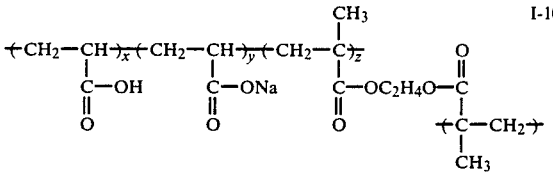

x:y:z = 64:9:27 (mol %)

I-11

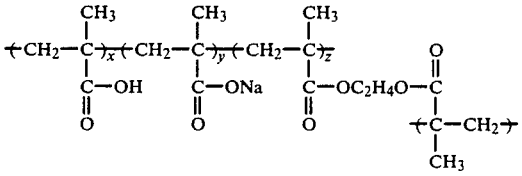

x:y:Z = 60:15:25 (mol %)

I-12

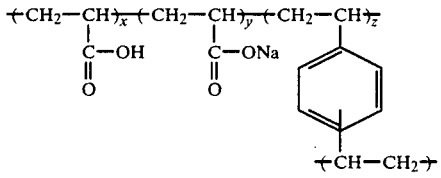

-continued x:y:z = 60:10:30 (mol %)

I-13

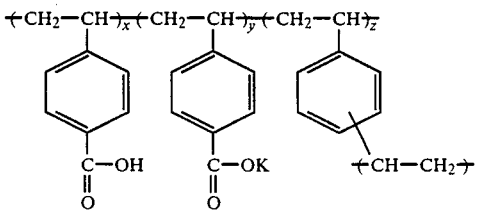

x:y:z = 64:11:25 (mol %)

Synthesis examples of these acid polymers are described in JP-A-62-220947.

The amount of the acid polymer is preferably from 0.01 g to 10 g, and particularly preferably from 0.2 g to 3 g per square meter of the light-sensitive material.

The acid polymer is preferably incorporated in a silver halide emulsion layer but may be incorporated in other hydrophilic colloid layers.

The light-sensitive silver halide emulsion for use in this invention may be spectrally sensitized to a blue light of relatively long wavelengths, a green light, a red light, or an infrared light by the use of sensitizing dyes.

Sensitizing dyes for use in the present invention include cyanine dyes, merocyanine dyes, complex cyanine dyes, complex merocyanine dyes, holopolar cyanine dyes, styryl dyes, hemicyanine dyes, oxonol dyes, and hemioxonol dyes.

Specific examples of sensitizing dyes for use in the present invention are described in *Research Disclosure*, Item 17643, IV-A, page 23, (December, 1978), ibid., Item 1831X, page 437 (August, 1979), and the literatures cited therein.

In the present invention, the sensitizing dye having a spectral sensitivity particularly suitable for the spectral characteristics of each scanner light source can be advantageously selected.

For example, the sensitizing dyes shown by the formula (II) below are preferably used for an LED light source and the sensitizing dyes shown by the formula (III) below are preferably used for a He-Ne laser light source:

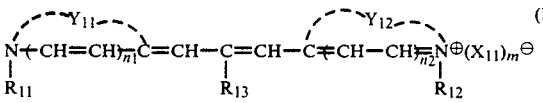

(II)

wherein $Y_{11}$ and $Y_{12}$ each represents a non-metallic atomic group necessary for forming a heterocyclic ring selected from a benzothiazole ring, benzoselenazole ring, naphthothiazole ring, a naphthoselenazole ring, and a quinoline ring, and each heterocyclic ring may be substituted by a lower alkyl group, an alkoxy group, a hydroxy group, an aryl group, an alkoxycarbonyl group, or a halogen atom; $R_{11}$ and $R_{12}$ each represents a lower alkyl group or an alkyl group having a sulfo group or a carboxy group; $R_{13}$ represents a lower alkyl group; $X_{11}$ represents an anion; $n_1$ and $n_2$ each represents 0 or 1; and m represents 0 or 1, when the dye forms an intramolecular salt, m is 0, and

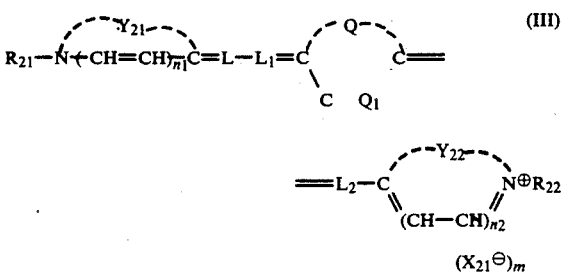

(III)

wherein $Y_{21}$ and $Y_{22}$ each represents a non-metallic atomic group which completes a 5- or 6-membered nitrogen-containing heterocyclic nucleus; $R_{21}$ and $R_{22}$ each represents an alkyl group, a substituted alkyl group, or an aryl group; Q and $Q_1$ represent non-metallic atomic groups which together complete a 4-thiazolidinone nucleus, a 5-thiazolidinone nucleus, or 4-imidazolidinone nucleus; L, $L_1$, and $L_2$ each represents a methine group or a substituted methine group; $X_{21}$ represents an anion; $n_1$ and $n_2$ each represents the integer 0 or 1; and m represents the integer 0 or 1, and when the dye forms an intramolecular salt, m is 0.

The compounds shown by the formula (II) described above are explained in detail as follows.

In formula (II), $Y_{11}$ and $Y_{12}$ each represents a nonmetallic atomic group necessary for forming a benzithiazole ring, a benzoselenazole ring, a naphthothiazole ring, a naphthoselenazole ring or a quinoline ring as described above and these heterocyclic rings each may be substituted by a lower alkyl group (e.g., methyl and ethyl), an alkoxy group (e.g., methoxy and ethoxy), a hydroxy group, an aryl group (e.g., phenyl), an alkoxycarbonyl group (e.g., methoxycarbonyl), a halogen atom (e.g., chlorine and bromine), etc.

$R_{11}$ and $R_{12}$ each represents a lower alkyl group (e.g., methyl, ethyl, propyl, and butyl), an alkyl group having a sulfo group [e.g., β-sulfoethyl, γ-sulfopropyl, γ-sulfobutyl, δ-sulfobutyl, and a sulfoalkoxyalkyl group (e.g., sulfoethoxyethyl and sulfopropoxyethyl)], or an alkyl group having a carboxy group (e.g., β-carboxyethyl, γ-carboxypropyl, γ-carboxybutyl, and δ-carboxybutyl).

$R_{13}$ represents methyl, ethyl, or propyl.

$X_{11}$ represents an anion usually used for cyanine dyes (e.g., halogen ion, benzenesulfonate ion, and p-toluenesulfonate ion).

Specific examples of the compound of formula (II) are illustrated below, but the invention is not limited thereto.

II-1

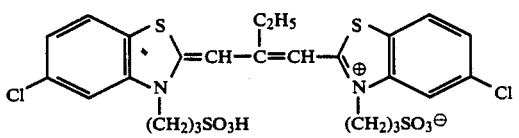

II-2

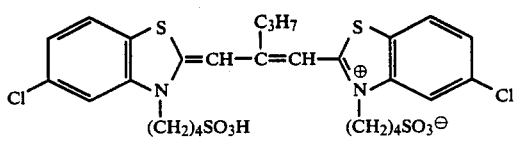

II-3

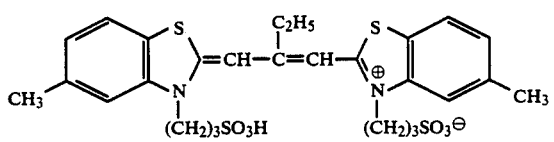

II-4

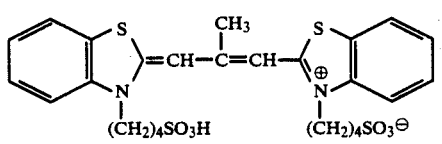

II-5

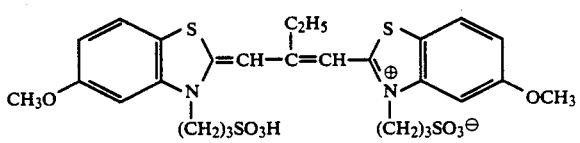

II-6

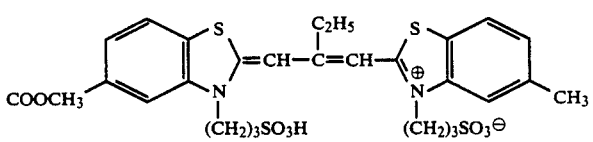

-continued
II-7
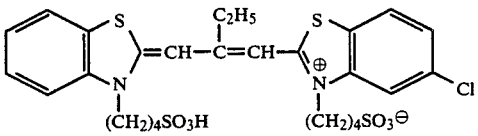
II-8
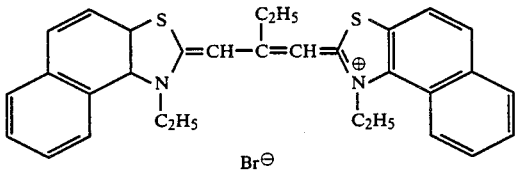
II-9
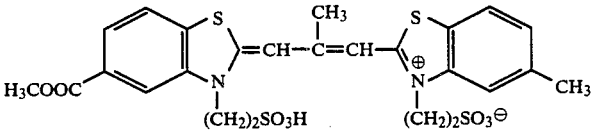
II-10
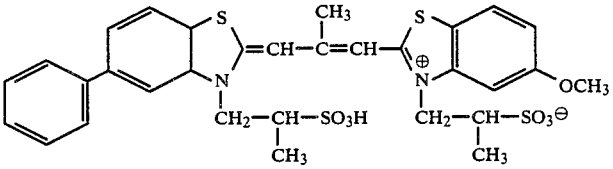
II-11
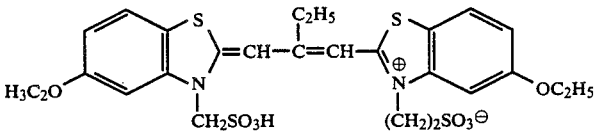
II-12
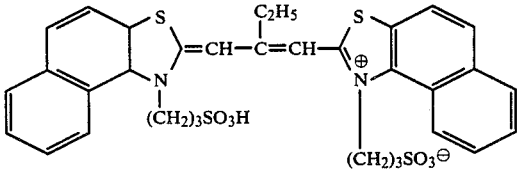
II-13
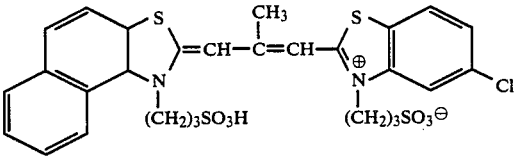
II-14
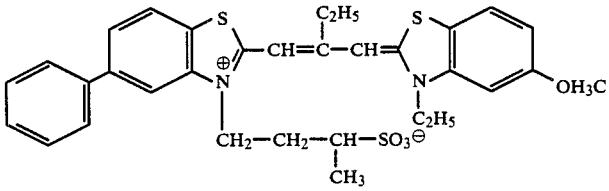
II-15
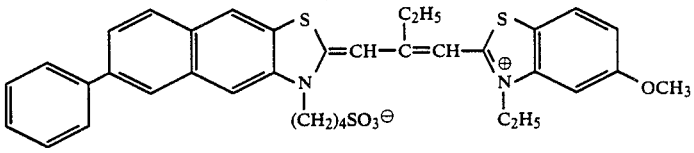

-continued
II-16
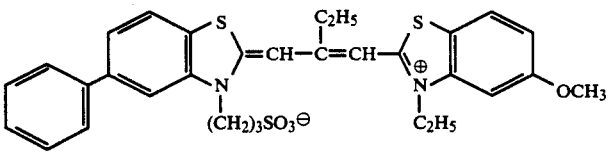
II-17
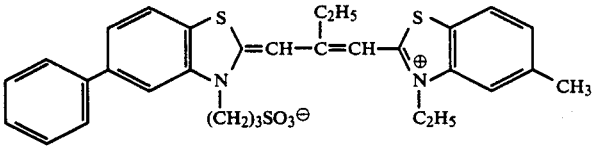
II-18
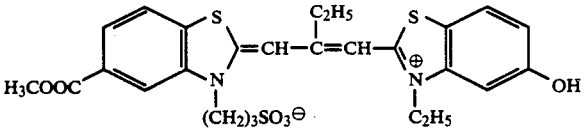
II-19
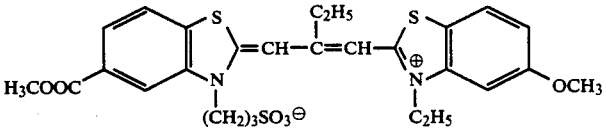
II-20
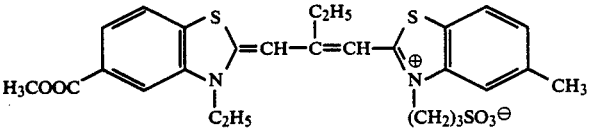
II-21
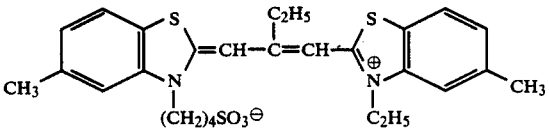
II-22
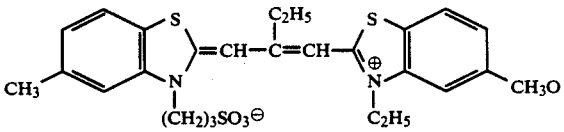
II-23
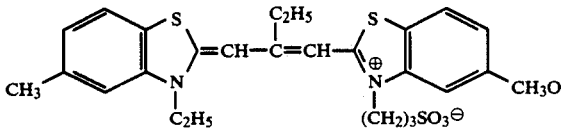
II-24
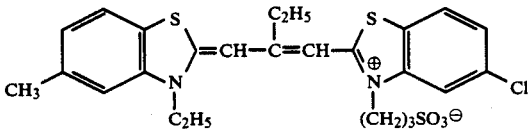
II-25
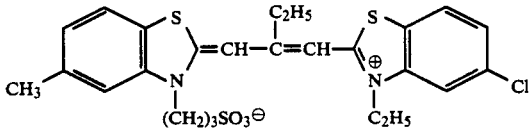

-continued

II-26

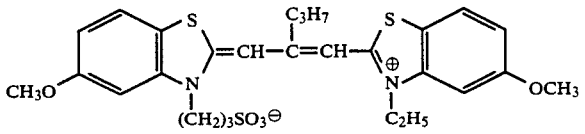

II-27

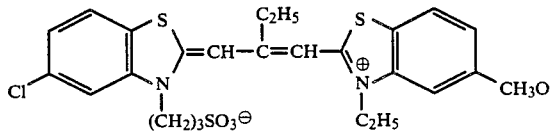

II-28

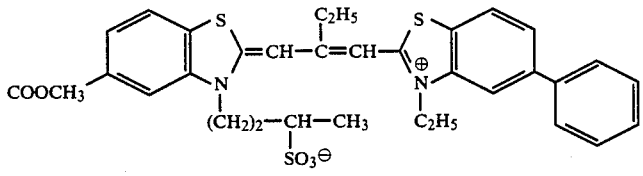

II-29

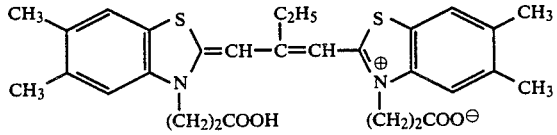

II-30

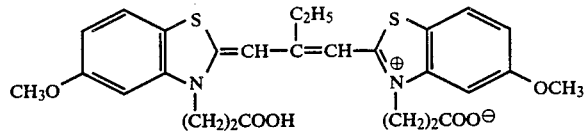

The sensitizing dyes shown by formula (III) above are further described as follows.

In formula (III), the nitrogen-containing heterocyclic nucleus completed by $Y_{21}$ or $Y_{22}$ is selected from the thiazole nuclei, benzothiazole nuclei, naphthothiazole nuclei, selenazole nuclei, benzoselenazole nuclei, naphthoselenazole nuclei, oxazole nuclei, benzoxazole nuclei, naphthoxazole nuclei, 2-quinoline nuclei, imidazole nuclei, benzimidazole nuclei, 3,3'-dialkylindolenine nuclei, 2-pyridine nuclei, and thiazoline nuclei. More preferably, at least one of $Y_{21}$ and $Y_{22}$ is a thiazole nucleus, a thaizoline nucleus, an oxazole nucleus, or a benzoxazole nucleus.

In formula (III), the alkyl group represented by $R_{21}$ or $R_{22}$ is an alkyl group having not more than 5 carbon atoms (e.g., methyl, ethyl, n-propyl, and n-butyl); the substituted alkyl group is substituted by an alkyl moiety having a carbon atom number of not more than 5, such as a hydroxyalkyl group (e.g., 2-hydroxyethyl, 3-hydroxpropyl, and 4-hydroxybutyl), a carboxyalkyl group (e.g., carboxymethyl, 2-carboxyethyl, 3-carboxypropyl, 4-carboxybutyl, and 2-(2-carboxyethoxy)ethyl), a sulfoalkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[3-(sulfopropoxy)ethoxy]ethyl, and 2-hydroxy-3-(3'-sulfopropoxy)propyl), an aralkyl group, the carbon atom number of said alkyl moiety being preferably from 1 to 5; and the aryl moiety being preferably a phenyl group, (e.g., benzyl, phenethyl, phenylpropyl, phenylbutyl, p-tolylpropyl, p-methoxyphenethyl, p-chlorophenethyl, p-carboxybenzyl, p-sulfophenethyl, and p-sulfobenzyl), an aryloxyalkyl group, the carbon atom number of said alkyl moiety being preferably from 1 to 5 and the aryl group of said aryloxy group being preferably a phenyl group (e.g., phenoxyethyl, phenoxypropyl, phenoxybutyl, p-methylphenoxyethyl, and p-methoxyphenoxypropyl), a vinylmethyl group, etc. Also, the aryl group represented by $R_{21}$ or $R_{22}$ may be a phenyl group, etc.

In formula (III), L, $L_1$ or $L_2$ represents a methine group or a substituted methine group $$(=\overset{\overset{R'}{|}}{C}-)$$

[wherein R' represents an alkyl group (e.g., methyl and ethyl), a substituted alkyl group [e.g., an alkoxyalkyl group (e.g., 2-ethoxyethyl), a carboxyalkyl group (e.g., 2-carboxyethyl), an alkoxycarbonylalkyl (e.g., 2-methoxycarbonylethyl), and an aralkyl group (e.g., benzyl and phenethyl)], or an aryl group (e.g., phenyl, p-methoxyphenyl, p-chlorophenyl and o-carboxyphenyl)].

Also, L and $R_{21}$ or $L_2$ and $R_{22}$ may combine with each other through a methine chain to form a nitrogen-containing heterocyclic ring.

In formula (III), Q and $Q_1$ form a thiazolidinone nucleus or an imidazolidinone nucleus and the nucleus may have a substituent at the nitrogen atom of the 3-position thereof. Examples of the substituent are an alkyl group (having preferably from 1 to 8 carbon atoms, e.g., methyl, ethyl, and propyl), an allyl group, an aralkyl group (the carbon atom number of the alkyl moiety being preferably from 1 to 5, e.g., benzyl and p-carboxyphenylmethyl), an aryl group (having preferably from 6 to 9 carbon atoms, e.g., phenyl and p-carboxyphenyl), a hydroxyalkyl group (the carbon atom number of the alkyl moiety being preferably from 1 to 5, e.g., 2-hydroxyethyl), carboxyalkyl group (the carbon atom number of the alkyl moiety being preferably from 1 to 5, e.g., carboxymethyl), and an alkoxycarbonylalkyl group (the carbon atom number of the alky group of the alkoxy moiety being preferably from 1 to 3 and the carbon atom number of the alkyl moiety being preferably from 1 to 5, e.g., methoxycarbonylethyl).

Also, examples of the anion represented by $X_{21}$ in formula (III) are a halide ion (e.g., iodide ion, bromide ion, and chloride ion), a perchlorate ion, a thiocyanate ion, a benzenesulfonate ion, a p-toluenesulfonate ion, a methylsulfate ion, and an ethylsulfate ion.

In the sensitizing dyes represented by formula (III) described above, the dyes represented by formula (III-A) below are particularly preferred.

(III-A)

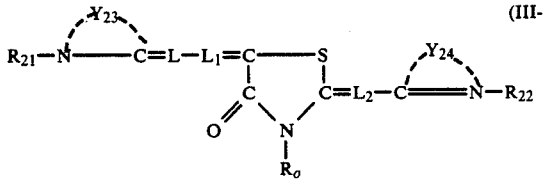

wherein $Y_{23}$ and $Y_{24}$, which may be the same or different, each represents a non-metallic atomic group which completes a thiazole nucleus, a benzothiazole nucleus or a benzoxazole nucleus; $R_o$ represents an alkyl group having from 1 to 6 carbon atoms (e.g., methyl, ethyl, and propyl), an allyl group, or an aralkyl group (the carbon atom number of the alkyl moiety being preferably from 1 to 5, e.g., benzyl and p-carboxyphenylmethyl), and $R_{21}$, $R_{22}$, L, $L_1$ and $L_2$ have the same meaning as defined in the formula (III).

Specific examples of the sensitizing dyes represented by formula (III) are illustrated below, but the invention is not limited thereto.

III-1

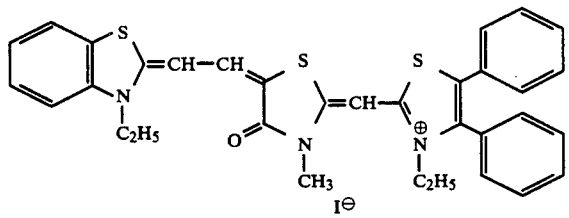

III-2

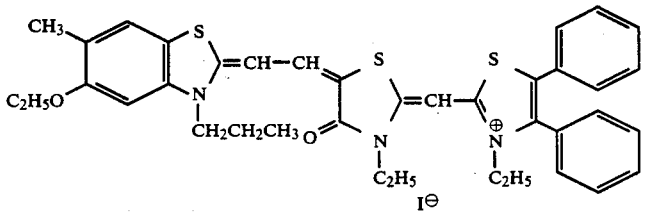

III-3

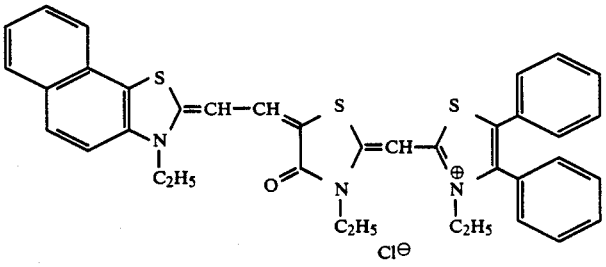

III-4

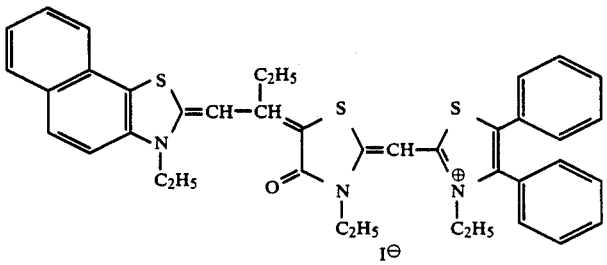

-continued
III-5
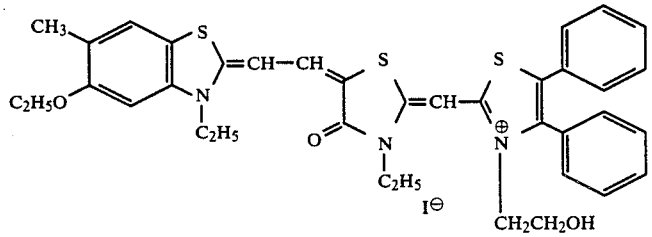
III-6
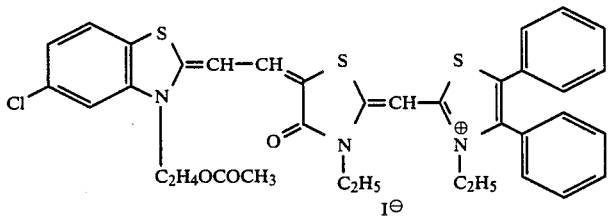
III-7
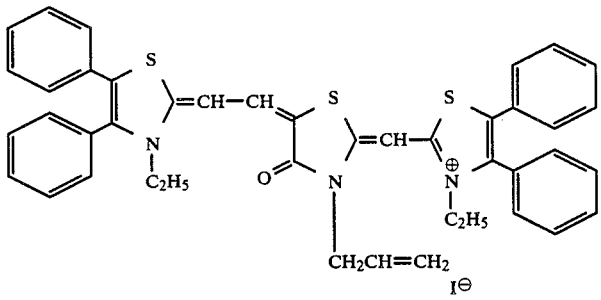
III-8
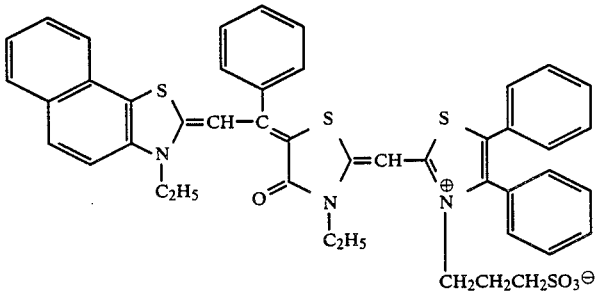
III-9
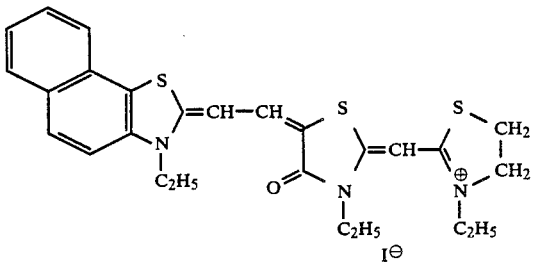
III-10
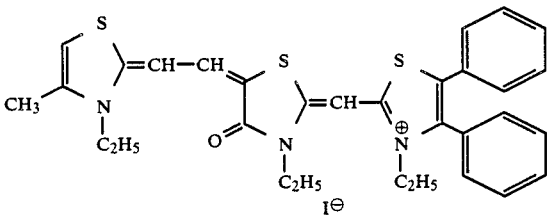

-continued
III-11
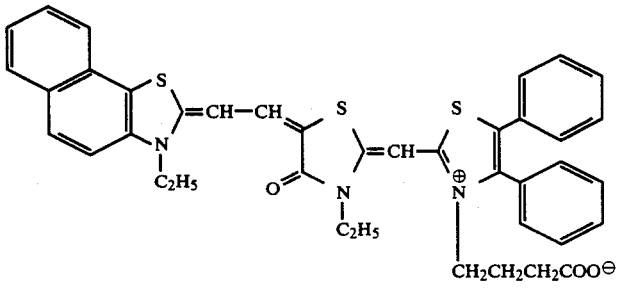
III-12
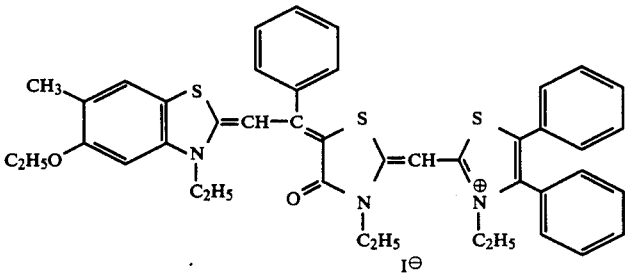
III-13
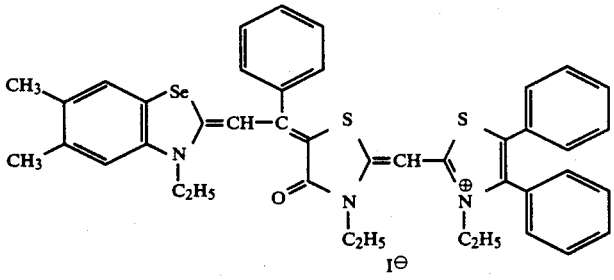
III-14
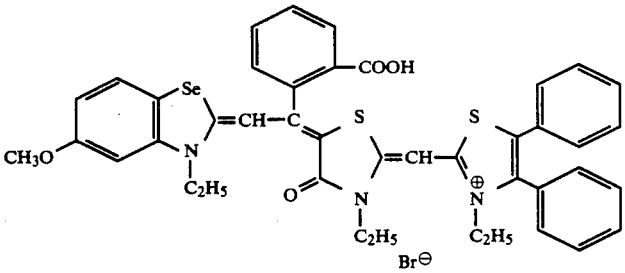
III-15
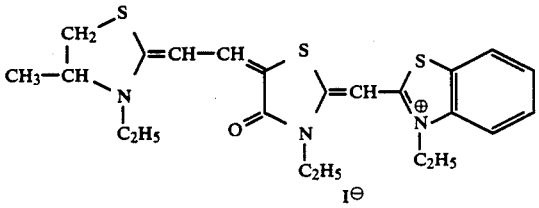
III-16
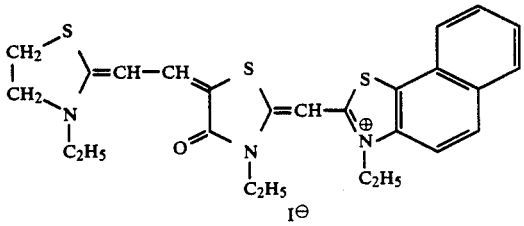

-continued

III-17

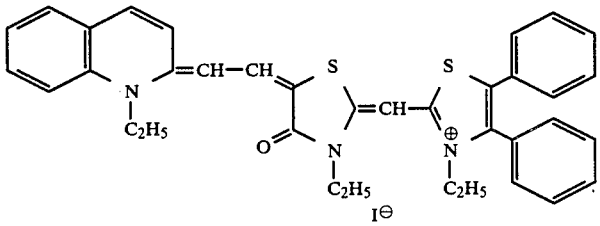

III-18

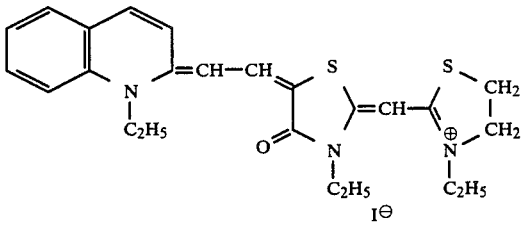

III-19

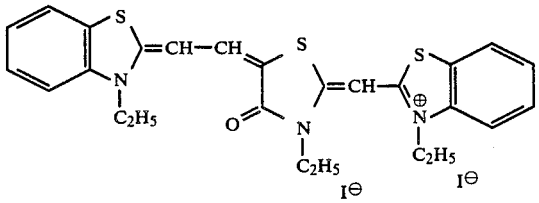

III-20

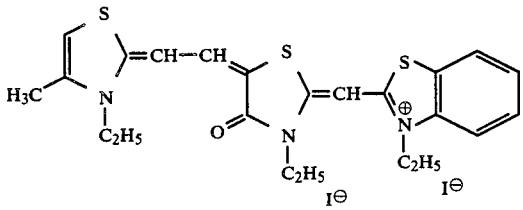

III-21

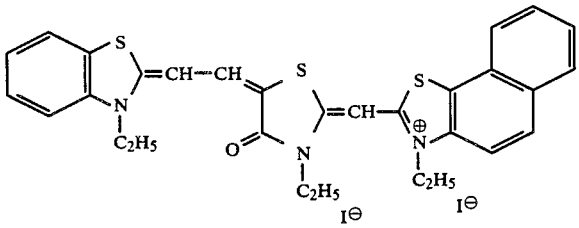

When the sensitizing dye shown by formula (II) or (III) described above is used for a silver halide emulsion of the present invention, the addition amount thereof depends upon the type of the silver halide and the kind of dye employed, but the optimum addition amount thereof is selected in a range of from 5 mg to 500 mg per mol of the silver halide.

Furthermore, for a He-Ne laser light source, the trinuclear cyanine dyes described in JP-A-50-62425, JP-A-54-18726, and JP-A-59-102229 can be used and also for an LED light source, the thiacarbocyanine dyes described in JP-B-48-42172, JP-B-51-9609, and JP-B-55-39818 and JP-A-62-284343 can be used. Also, for a semiconductor laser light source dicarbocyanines having a 4-quinoline nucleus as described in JP-A-59-192242 and the tricarbocyanines described in JP-A-59-191032 and JP-A-60-80841 can be advantageously used.

Typical examples of these sensitizing dyes are illustrated below.

IV-1

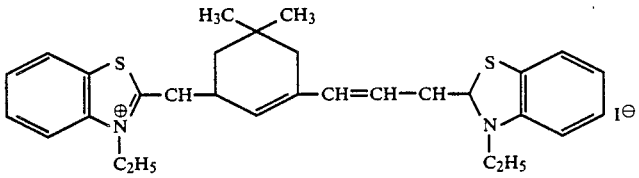

-continued

IV-2

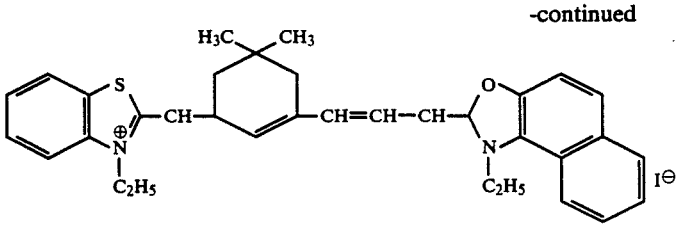

IV-3

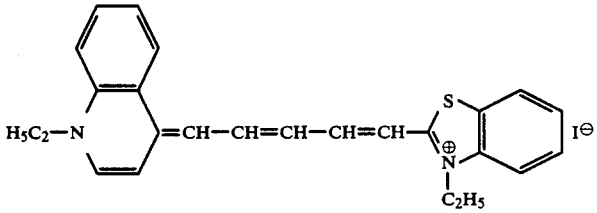

IV-4

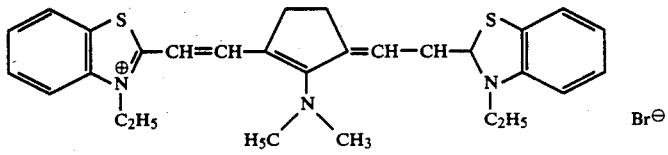

IV-5

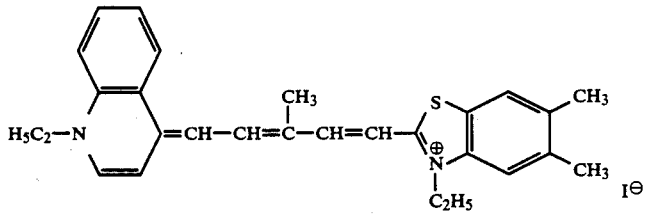

IV-6

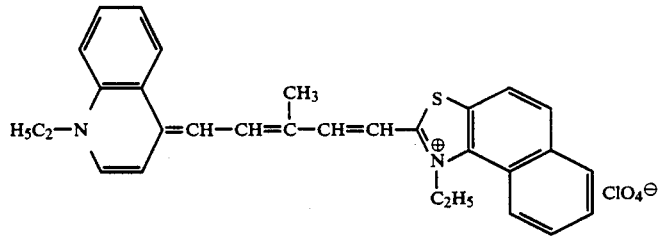

In particular, combination use of a sensitizing dye represented by formula (II) and a sensitizing dye represented by formula (III) described above is preferred for providing high sensitivity.

These sensitizing dyes can be used singly or in combination thereof, and a combination of sensitizing dyes is frequently used for the purpose of super color sensitization.

The silver halide emulsion for use in the present invention may contain, together with the sensitizing dye(s), a dye having no spectral sensitizing action by itself or a material which does not substantially absorb visible light. Moreover, the silver halide emulsion may be super color-sensitized according to the method described in JP-A-54-18726.

Sensitizing dyes, combinations of dyes showing super color sensitization, and materials showing super color sensitization for use in the present invention are described in *Research Disclosure*, Vol. 176, No. 17643, pages 23, IV-J (December, 1978).

The silver halide photographic material of the present invention may contain various compounds for inhibiting the formation of fog during the production, storage, and processing of the photographic light-sensitive materials or for stabilizing the photographic performance thereof. That is, the light-sensitive materials may contain vaious antifoggants and/or stabilizers such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.), mercaptopyrimidines, mercaptotriazines, thioketo compounds (e.g., oxazolinethine), azaindenes [e.g., triazaindene, tetraazaindenes (in particular, 4-hydroxy-substituted (1,3,3a,7)tetraazaindenes), and pentaazaindenes], benzenethiosulfonic acid, benzenesulfinic acid, and benzenesulfonic acid amide.

Polyhydroxybenzene compounds are perferred for improving the pressure resistance of the silver halide photographic material of the present invention without reducing the sensitivity thereof. Polyhydroxybenzene compounds having the following structures are preferred:

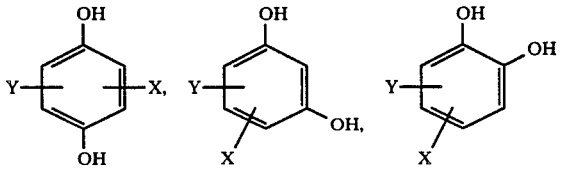

wherein X and Y each represents —H, —OH, a halogen atom, —OM (wherein M erpresents an alkali metal ion), an alkyl group, a phenyl group, an amino group, a carbonyl group, a sulfon group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkyl ether group, an alkylphenyl group, an alkyl thioether group, or a phenyl thioether group. The alkyl moiety of these group preferably has from 1 to 3 carbon atoms.

More preferably, X and Y each represents —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

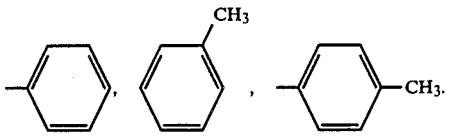

Examples of the particularly preferred polyhydroxybenzene compounds for use in the present invention are as follows.

A-(1)

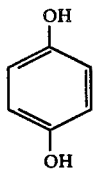

A-(2)

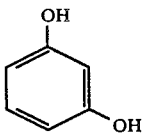

A-(3)

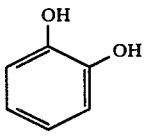

A-(4)

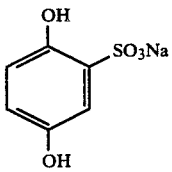

A-(5)

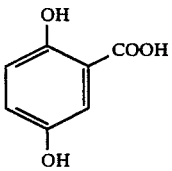

A-(6)

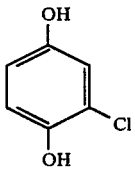

A-(7)

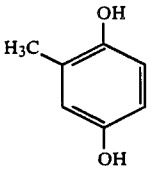

A-(8)

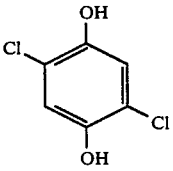

A-(9)

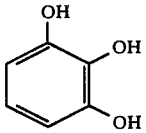

-continued

A-(10)

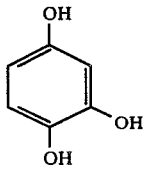

A-(11)

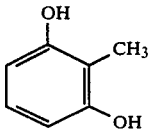

A-(12)

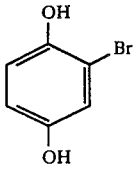

A-(13)

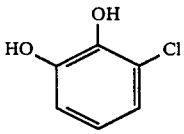

A-(14)

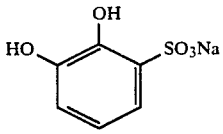

A-(15)

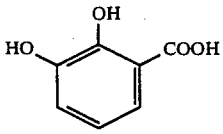

A-(16)

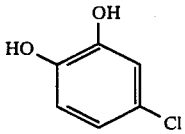

A-(17)

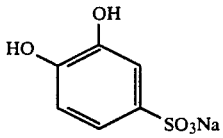

A-(18)

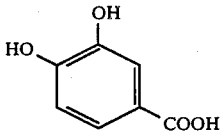

A-(19)

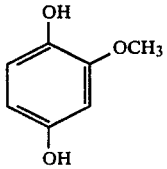

A-(20)

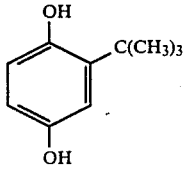

A-(21)

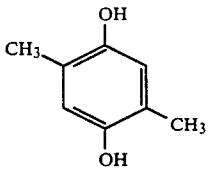

The polyhydroxy compound may be present in the silver halide emulsion layer(s) of the light-sensitive material of the present invention or in other layers. The effective addition amount thereof is from $10^{-5}$ mol to 1 mol per mol of the silver halide and the particularly effective amount thereof is from $10^{-3}$ mol to $10^{-1}$ mol.

The photographic light-sensitive materials of the present invention may further contain in the hydrophilic colloid layers water-soluble filter dyes or other water-soluble dyes for various purposes such as for the inhibition of irradiation, etc.

Examples of water-soluble dyes for use in the present invention include are oxonol dyes, hemioxanol dyes, styryl dyes, merocyanine dyes, cyanine dyes, and azo dyes. Of these dyes, the oxonol dyes, hemioxonol dyes, and merocyanine dyes are particularly useful.

The photographic light-sensitive material of the present invention may further contain in the photographic emulsion layers developing agents such as a polyalkylene oxide or the derivatives thereof (e.g., the ethers, esters, and amines), thioether compounds, thiomorpholines, quaternary ammonium salts, urethane derivatives, urea derivatives, imidazole derivatives, 3-pyrazolidones, aminophenols, etc., for increasing the sensitivity, the contrast, and/or for accelerating development.

Of these compounds, the 3-pyrazolidones (e.g., 1-phenyl-3-pyrazolidone and 1-phenyl-4-methyl-4-hydroxymethyl-3-pyrazolidone) are preferred and the addition amount thereof is usually not more than 5 $g/m^2$, and is preferably from 0.01 $g/m^2$ to 0.2 $g/m^2$ of the silver halide photographic material.

Also, the photographic light-sensitive material of the present invention may further contain inorganic or organic hardening agents in the photographic emulsion layers and light-insensitive hydrophilic colloid layers.

Specific examples of the hardening agents for use in the present invention include active vinyl compounds [e.g., 1,3,5-triacryloyl-hexahydro-s-triazine, bis(vinylsulfonyl)methyl ether, and N,N-methylene-bis[β-bis(-vinylsulfonyl)propionamide]], active halogen compounds (2,4-dichloro-6-hydroxy-s-triazine), mucohalogenic acids (e.g., mucochloric acid), N-carbamoylpyridinium salts [e.g., (1-morpholi)carbonyl-3-pyridinio)methanesuflonate], and haloamidinium salts [e.g., (1-(1-chloro-1-pyridinomethylene)pyrrolidinium and 2-naphthalene sulfonate). The hardening agents can be used singly or in combination thereof.

Of the aforesaid hardening agents, the active vinyl compounds described in JP-A-53-41220, JP-A-53-57257, JP-A-59-162546 and JP-A-60-80846 and the active halogen compounds described in U.S. Pat. No. 3,325,287 are preferred.

The photographic light-sensitive material of the present invention may further contain in the photographic emulsion layers or other hydrophilic colloid layers various surface active agents as coating aids, for static prevention, the improvement of slidability, emulsion dispersibility, to prevent tackiness, and to enhance photographic characteristics (e.g., development acceleration and the increase of contrast and sensitivity).

Examples of surface active agents for use in the present invention include nonionic surface active agents such as saponin (steroid series), alkylene oxide derivatives (e.g., polyethylene glycol, polyethylene glycol/-polyporpylene glycol condensation products, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride and alkylphenol polyglyceride), fatty acid esters of polyhydric alcohols, alkyl esters of succharides, etc.; anionic surface active agents having acid groups (e.g., a carboxy group, a sulfo group, a phospho group, a sulfuric acid ester group, and a phosphoric acid ester group), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers, polyoxyethylene alkylphosphoric acid esters; amphoteric surface active agents such as amino acids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic quaternary ammonium salts, aromatic quaternary ammonium salts, heterocyclic quaternary ammonium salts (e.g., pyridiums and imdiazoliums), aliphatic phosphonium salts, aliphatic sulfonium salts, phosphonium salts or sulfonium salts containing a heterocyclic ring.

Also, for static prevention, the nitrogen-containing surface active agents described in JP-A-60-80849 are preferably used.

The photographic light-sensitive materials of the present invention can further contain a matting agent such as silica, magnetic oxide, polymethyl methacrylate particles, etc., in the photographic emulsion layers or other hydrophilic colloid layers to prevent tackiness.

The photographic light-sensitive material of the present invention can contain a dispersion of a water-soluble or water sparingly soluble synthetic polymer to enhance dimensional stability. Examples include polymers composed of an alkyl (meth)acrylate, an alkoxyacryl (meth)acrylate, a glycidyl (meth)acrylate, etc., singly or in combination thereof or as a combination of the aforesaid monomer and acrylic acid, methacrylic acid, etc.

As a binder or a protecitive colloid for the photographic emulsion layers or other layers of the light-sensitive material of the present invention, gelatin is advantageously used, but other hydrophilic colloids can be also used. Examples thereof are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; sodium alginate; saccharide derivatives such as starch derivatives, etc.; and various kinds of synthetic polymers or copolymers such as polyvinyl alcohol, polyvinyl alcohol partial acetal, poly-N-vinylpyrroldione, polyacrylic acid, polymethacrylic acid, polyacrylamide, polyvinyl imidazole, polyvinylpyrazole, etc.

As gelatin, limed gelatin as well as acid-treated gelatin can be used in the photographic material of the present invention and further, a gelatin hydrolyzed product or a gelatin enzyme-decomposition product can be also used.

The silver halide emulsion layers for use in the present invention may contain a polymer latex such as an alkyl acrylate latex.

As a support for the photographic light-sensitive material of the present invention, films of cellulose triacetate, cellulose diacetate, nitrocellulose, polystyrene, polyethylene terephthalate, etc., papers, baryta-coated papers, polyolefin-coated papers, etc., can be used.

There is no particular restriction on the developing agent for use in developing the light-sensitive material of this invention, but the dihydroxybenzenes are preferred for obtaining good dot image quality. A combination of a dihydroxybenzene and a 1-phenyl-3-pyrazolidone or a combination of a dihydroxybenzene and a p-aminophenol can be also used as the developer.

Examples of the dihydroxybenzene developing agents for use in processing the photographic material of the present invention include hydroquinone, chlorohydroquinone, bromohydroquinone, isopropylhydroquinone, methylhydroquinone, 2,3-dichlorohydroquinone, 2,5,-dichlorohydroquinone, 2,3-dibromohydroquinone, and 2,5-dimethylhydroquinone.

1-phenyl-3-pyrazolidone or the derivatives thereof can be also used as the developing agent for use in processing the photographic material of the present invention and examples thereof include 1-phenyl-3-pyrazolidone, 1-phenyl-4,4-dimethyl-3-pyrazolidone, 1-phenyl- 4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Furthermore, as the developer, p-aminophenol series developing agents can be also used and examples thereof include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

The developing agent is used in an amount of from 0.05 mol/liter to 0.8 mol/liter. Also, when a combination of a dihydroxybenzene and a 1-phenyl-3-pyrazolidone or a p-aminophenol is used, the former is preferably used in an amount of from 0.05 mol/liter to 0.5 mol/liter and the later in an amount of less than 0.06 mol/liter.

The developer for use in processing the light-sensitive material of the present invention may further contain a sulfite as a preservative. Examples of the sulfite include sodium sulfite, potassium sulfite, lithium sulfite, ammonium sulfite, sodium hydrogen-sulfite, potassium meta-hydrogensulfite, and sodium formaldehyde hydrogensulfite. The amount of the sulfite in the developer is at least 0.3 mol/liter, and preferably at least 0.4 mol/liter. Also, the upper limit of the sulfite is 2.5 mol/liter and is preferably 1.2 mol/liter.

For adjusting pH of the developer, pH adjusting agents or buffers such as sodium hydroxide, potassium hydroxide, sodium carbonate, potassium carbonate, sodium tertiary phosphate, potassium tertiary phosphate, sodium silicate, and potassium silicate may be used.

The developer for use in the present invention may further contain other additives such as development inhibitors (e.g., boric acid, borax, sodium bromide, potassium bromide, and potassium iodide), organic solvents (e.g., ethylene glycol, diethylene glycol, triethylene glycol, dimethylformamide, methyl cellosolve, hexylene glycol, ethanol, and methanol), antifoggants such as the mercapto series compounds (e.g., 1-phenyl-5-mercaptotetrazole and sodium 2-mercaptobenzimidazole-5-sulfonate), indazole series compounds (e.g., 5-nitroindazole), and benztriazole series compounds (e.g., 5-methylbenztriazole), etc. Furthermore, if necessary, the developer may contain a toning agent, a surface active agent, a defoaming agent, a water softener, a hardening agent, etc. In particular, the amino compounds described in JP-A-56-106244 and the imidazole compounds described in JP-B-48-35493 are preferred for accelerating development or for increasing sensitivity.

Also, the developer for use in processing the silver halide photographic material of the present invention may contain the compounds described in JP-A-56-24327 as a silver stain inhibitor, the compound described in JP-A-62-212651 as an uneven development inhibitor, and the compounds described in JP-A-61-267759 as a dissolution aid.

Moreover, the developer for use in the present invention may contain boric acid as described in JP-A-62-186259, the saccharides (e.g., saccharose) described in JP A-60-93433, oximes (e.g., acetoxime), phenols (e.g., 5-sulfosalicylic acid), and tertiary phosphates (e.g., the sodium salt and the potassium salt) as a buffer.

The light-sensitive material of the present invention is fixed by a fix solution after development.

The fix solution for use in processing the silver halide photographic material of the present invention is an aqueous solution containing a fixing agent and, if necessary, a hardening agent (e.g., a water-soluble aluminum compound), acetic acid, and a dibasic acid (e.g., tartaric acid, citric acid), or the salt thereof. The pH of the fix solution is at least 3.8 and is preferably from 4.0 to 5.5.

Fixing agents for use in the fix solution of the present invention include sodium thiosulfate and ammonium thiosulfate and the use of ammonium thiosulfate is preferred for its fixing speed. The amount of the fixing agent in the fix solution is generally from about 0.1 mol/liter to about 5 mols/liter.

The water-soluble aluminum salt which mainly functions as a hardening agent for an acid hardening fix solution. Examples thereof are aluminum chloride, aluminum sulfate, and potassium alum.

As the aforesaid dibasic acid, tartaric acid or the derivatives thereof and citric acid or the derivatives thereof can be used singly or in combination thereof. The addition amount of the dibasic acid is generally at least 0.005 mol/liter, and preferably from 0.01 mol/liter to 0.03 mol/liter.

Typical examples of the basic acid or the salts thereof are tartaric acid, potassium tartrate, sodium tartrate, sodium potassium tartrate, ammonium tartrate, and ammonium potassium tartrate.

Cittric acid or the derivatives thereof can also be added to the fixing solution, including sodium citrate and potassium citrate.

The fix solution may further contain, if desired, a preservative (e.g., sulfites and hydrogen-sulfites), a pH buffer (e.g., acetic acid and boric acid), a pH controlling agent (e.g., ammonia and sulfuric acid), an image storage improving agent (e.g., potassium iodide), and a chelating agent.

The amount of the pH buffer in the fix solution is from 10 g/liter to 40 g/liter, and preferably from 18 g/liter to 25 g/liter since the developer is highly alkaline.

The fixing temperature and time are same as those for the development and is preferably from about 20° C. to about 50° C. and from one minute to 10 seconds.

The light-sensitive material of the present invention is washed and dried after development and then fixed. Next, a wash step is performed to the extent of almost completely removing the silver salt dissolved in the fix processing.

The wash solution may contain antifungal agents (e.g., the compounds described in *Bookin Boobai no Kagaku (Antibacterial and Antifungal Chemistry)* and the compounds described in JP-A-62-115154), wash accelerators (e.g., sulfites), chelating agents, etc.

The wash step is carried out preferably in a time of from 10 second to 3 minutes at temperature of from about 50° C. to about 20° C.

Drying is usually performed at from about 40° C. to about 100° C. The drying time is adjusted according to the ambient conditions, but is usually from about 5 seconds to 3 minuted and 30 seconds.

The light-sensitive materials of the present invention can be processed by a roller trasporting type automatic processor as described in U.S. Pat. Nos. 3,025,779 and 3,545,971, which is referred to herein as a roller transporting type processor.

A roller transporting type processor can carry out the 4 steps of development, fix, wash and drying. The processor for use in the present invention is preferably configured to perform these 4 steps, although additional steps may be employed, if desired.

The wash step can be carried out by using a counter-current wash system of two or three stages in order to save water.

The developer for use in processing the material of the present invention is preferably stored in a container having a low oxygen permeability as described in JP-A-61-73147. Also, for processing the light-sensitive material of the present invention, the replenishing system described in JP-A-62-91939 is preferably used.

Since the silver halide photographic material of the present invention provides a high $D_{max}$, a high density is maintained, even when the dot areas of the photographic material are subjected to reduction processing after image formation.

There is no particular restriction on the reduction processing for use in the present invention, and the reduction for use in the present invention, and the reduction methods described in Mees, *The Theory of the Photographic Process*, pages 738 to 744 (published by Macmillan, 1954), Tetsuo Yano, *Shahin Shori sono Riron to Jissai (Photographic Processing and the Theory and Practice Thereof)*, pages 166 to 169 (published by Kyorisu Shuppan K.K., 1978), and JP-A-50-27543, JP-A-52-68429, JP-A-55-17123, JP-A-55-79444, JP-A-57-10140, JP-A-57-142639, and JP-A-61-61155 are useful.

That is, an image reduction solution or reducer containing a permanganate, a persulfate, a ferric salt, cupric salt, ceric salt, potassium ferricyanide, a dichromate, etc., singly or in combination thereof as an oxidizing agent, and containing, if necessary, an inorganic acid and an alcohol, or an image reduction solution containing an oxidizing agent such as potassium ferricyanide, ethylenediaminetetraacetic acid ferric salt, etc., a silver halide solvent such as a thiosulfate, rhodanide, thiourea, or the derivatives thereof, etc., and, if necessary, an inorganic acid such as sulfuric acid can be used.

Typical examples of the image reduction solution for use in the present invention include Farmer's reducer, an ethylenediaminetetraacetic acid ferric salt reducer, a potassium permanganate reducer, an ammonium persulfate reducer (Kodal R-5), and a ferric salt reducer.

Preferably, the image reduction step is completed within several seconds to several tens minutes at a temperature of from 40° C. to 10° C., and particularly from 30° C. to 15° C. By using the light-sensitive material of the present invention for making printing plates, a sufficiently wide image reduction latitude can be obtained within the aforesaid conditions.

The reducer, or image reduction solution, acts on the silver images formed in the silver halide emulsion layer(s) through the insensitive upper layer containing the polymer compound of the present invention.

The image reduction solution may be applied by various means including, for example, immpersing a light-sensitive material of the present invention for plate making in a image reduction solution while stirring the liquid, and applying an image reduction solution onto the surface of the light-sensitive material for plate making by a brush or a roller.

The invention is further described in detail with reference to the following examples, but the invention is not limited thereto.

EXAMPLE 1

Preperation of Emulsion

Emulsion A:

To an aqueous gelatin solution containing 1,8-dihydroxy-3,6-dithiaoctane, an aqueous solution of potassium iodide and potassium bromide and an aqueous solution of silver nitrate were added with vigorous stirring over a period of 15 minutes at 75° C. while controlling the pAg at 8.0 to provide a mono-dispersed octahedral silver iodobromide emulsion having a mean grain size of 0.25 μm and an iodide content of 6 mol %. This emulsion served as the core material.

To the above silver iodobromide core emulsion, an aqueous potassium bromide solution containing $10^{-7}$ mol of $K_3IrCl_1$ per mol of AgI and an aqueous silver nitrte solution were added such that the pAg thereof became 7.4, to provide a core/shell silver iodobromide emulsion. The iodide content of the shell was 0.5 mol %.

After removing the soluble salts from the emulsion by an ordinary manner, the emulsion was chemically sensitized by adding 3 mg of sodium thiosulfate and 4 mg of chloroauric acid per mol of silver over a period of 70 minutes at 65° C. Thereafter, an aqueous solution of 1% 4-hydroxy-6-methyl-1,3,3a,7-tetraazaindene was added to the emulsion as a stabilizer in an amount of 30 ml per mol of silver.

A mono-dispersed cubic silver halide emulsion having a mean silver iodide content of 1.5 mol % and a mean grain size of 0.45 μm (coefficient of variation 10%) was thereby obtained.

Emulsion B:

The same procedure for preparing Emulsion A was followed except that the amount of potassium iodide was adjusted to provide a core iodide content of 10 mol % to obtain Emulsion B.

Emulsion C: (comparison)

The same procedure for preparing Emulsion A was followed except that the amount of potassium iodide was adjusted to provide core and shell structures, both having an iodide content of 1.5 mol %. Emulsion C having a uniform halogen composition was thereby prepared.

Preparation of Coated Sample 50 mg of 3,3'-di(3-sulfopropyl)-5,5'-dichloro-9-ethylbenz[1,2-d]thiacarbocyanine sodium salt and 50 mg of 3,3'-di(3-sulfopropyl)-9-ethyl-naphtho[1,2-d]thiacarbocyanine sodium salt were added to each of the emulsions as prepared above as spectral sensitizing dyes per mol of silver halide. The compound of formula (I) was further added to each emulsion as shown in Table 1 below. Furthermore, after adding thereto 3 g of hydroquinone and 50 mg of 1-phenyl-5-mercaptotetrazole per mol of silver as an antifoggant, 25% by weight based on the weight of the gelatin binder of polyethylene acrylate latex as a plasticizer, and 120 mg/m$^2$ of 2,4-dichloro-6-hydroxy-s-triazine as a hardening agent, the emulsion was coated on a polyester support at a silver coverage of 4.5 g/m$^2$. The coverage of gelatin was 4.7 g/m$^2$.

On the above emulsion layer were simultaneously formed a first protective layer containing 0.9 g/m$^2$ of gelatin, 225 mg/m$^2$ of a polyethyl acrylate latex, 200 mg/m² each of dyes having the following structures (1) and (2), and sodium dodecylbenzensulfonate as a coating aid and a second protective layer containing 0.7 g/m² of gelatin, 200 mg/m² of colloidal silica having particle sizes of from 10 μm to 20 μm as a matting agent, 100 mg/m² of a silicone oil, 50 mg/m² of sodium dodecylbenzenesulfate as a coating aid, and 5 mg/m² of a fluorineseries surface active agent having the following formula (3) to provide the coated sample.

(1)

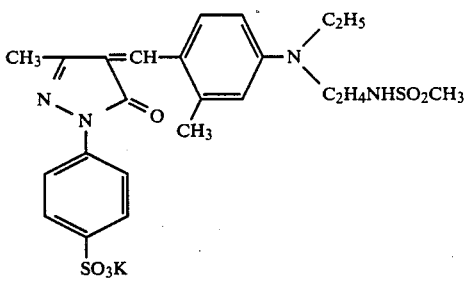

(2)

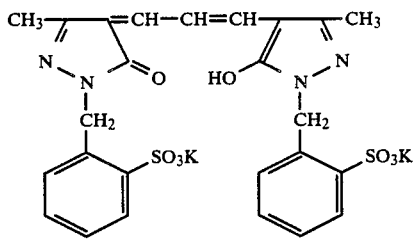

(3)

$C_8F_{17}SO_2N(C_3H_7)CH_2COOK$

Evaluation of Sensitivity

Each sample thus prepared was exposed to a xenon light flash of $10^{-5}$ seconds through an interference filter having a peak at 670 nm and a continuous wedge. The sample was developed by Developer A shown below for 30 seconds at 35° C., fixed by Fix Solution B for 60 seconds at 25° C., washed, and dried. Sensitometry was then performed.

The relative sensitivity of each sample is shown in Table 1 below, wherein the relative sensitivity is shown as the reciprocal of the exposure amount providing a density of 3.0.

Evaluation of Pressure Resistance

A load of 80 g was placed on sapphire needle (diameter: 0.1 mm) and a pressure was applied by sliding the needle on surface of each sample at a speed of 60 cm/min. The unexposed sample was developed, fixed, washed and dried as above. The density of the pressed portions was measured using a microdensitometer having an aperture of 50 μm and the difference between the density of the pressed portion and the density of the unpressed portion is shown in Table 1 below as ΔD.

As shown in Table 1 below, it can be seen that the samples Nos. 4 of 7 and 10 to 12 of the present invention have a high sensitivity and are excellent in pressure resistance.

The processing solutions used above were as follows.

| | | |
|---|---|---|
| Developer A | | |
| Water | 720 | ml |
| Diethylenediaminetetraacetic Acid Di-Sodium Salt | 4 | g |
| Sodium Hydroxide | 44 | g |
| Sodium Sulfite | 45 | g |
| 2-Methylimidazole | 2 | g |
| Sodium Carbonate | 26.4 | g |
| Boric Acid | 1.6 | g |
| Potassium Bromide | 1 | g |
| Hydroquinone | 36 | g |
| Diethylene Glycol | 39 | g |
| 5-Methylbenztriazole | 0.2 | g |
| Pyrazone | 0.7 | g |
| Water to make | 1 | liter |
| Fix Solution B | | |
| Ammonium Thiosulfate | 170 | g |
| Sodium Sulfite (anhydrous) | 15 | g |
| Boric Acid | 7 | g |
| Glacial Acid | 15 | ml |
| Potassium Alum | 20 | g |
| Ethylenediaminetetraacetic Acid | 0.1 | g |
| Tartaric Acid | 3.5 | g |
| Water to make | 1 | liter |

TABLE 1

| Sample No. | Emulsion | Compound of Formula (I) | Amount* | Relative Sens. | Pressure Resist (ΔD) |
|---|---|---|---|---|---|
| 1 | A | — | — | 130 | 1.5 |
| 2 | B | — | — | 124 | 1.4 |
| 3 | C | — | — | 100 | 2.0 |
| 4 | A | I-5 | 200 | 126 | 0.6 |
| 5 | " | " | 400 | 125 | 0.4 |
| 6 | " | I-8 | 200 | 125 | 0.5 |
| 7 | " | " | 400 | 125 | 0.4 |
| 8 | " | Comparison Compound (a) | " | 126 | 1.4 |
| 9 | " | Comparison Compound (b) | " | 124 | 1.5 |
| 10 | B | I-5 | 200 | 121 | 0.5 |
| 11 | " | " | 400 | 120 | 0.4 |
| 12 | " | I-8 | " | 120 | 0.4 |
| 13 | " | Comparison Compound (a) | " | 121 | 1.3 |
| 14 | " | Comparison Compound (b) | " | 120 | 1.4 |
| 15 | C | I-5 | 200 | 97 | 0.8 |
| 16 | " | " | 400 | 95 | 0.7 |
| 17 | " | I-8 | " | 96 | 0.8 |

In the above table:
*mg/m²
Sample Nos. 1 to 3, 8, 9, and 13 to 17 are comparative samples examples.
Sample Nos. 4 to 7 and 10 to 12 are samples of the present invention.

The comparison compounds shown in the above table are as follows.

Comparison Compound (a):

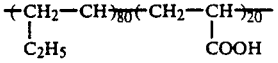

Comparison Compound (b):

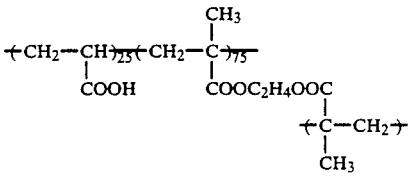

EXAMPLE 2

Samples prepared as in Example 1 were light-exposed as in Example 1 and then processed using a developer GR-Dl of Fuji Grandex (trade name, a system of super-high contrast photographic materials using hydrazine derivatives for graphic arts, made by Fuji Photo Film Co) and a fix solution, GR-Fl of Fuji Grandex for 30 seconds at 34° C. in each processing step. The relative sensitivity and the pressure resistance. Were evaluated as in Example 1. Sample Nos. 4 to 7 and 10 to 12 of the present invention showed equivalent good results as in Example 1.

EXAMPLE 3

Emulsions A' and B' were prepared as follows.

Emulsion A':

The same procedure used to prepare Emulsion A as in Example 1 was followed except that the amount of sodium thiosulfate was changed to 3.61 g ($1.9\times10^{-5}$ mol), to provide Emulsion A'.

Emulsion B': (comparison)

An aqueous solution of potassium iodide and potassium bromide and an aqueous silver nitrate solution were simultaneously added to an aqueous gelatin solution containing 260 mg of 1,8-dihydroxy-3,6-dithiaoctane per mol of silver with vigorous stirring for a period of 15 minutes at 75° C. while controlling the pAg to 8.0 to provide a mono-dispersed octahedral silver iodobromide grain emulsion having a mean grain size of 0.25 μm and a iodide content of 6 mol %. This emulsion served as a core material.

Then, by adding an aqueous potassium bromide solution containing $10^{-7}$ mol of $K_3IrCl_6$ per mol of Ag and an aqueous silver nitrate solution to the aforesaid silver iodobromide core emulsion such that the pAg became 7.4, a core/shell silver iodobromide emulsion was thereby obtained. The iodide content of the shell was 0.5 mol %.

After removing soluble salts from the emulsion by an ordianry manner, $2.5\times10^{-5}$ mol of sodium thiosulfate per mol of silver was added to the emulsion and the emulsion was sulfur-sensitized for 50 minutes at 65° C. Then, 30 ml of an aqueous solution of 1% 4 hydroxy-6-methyl-1,3,3a,7-tetraazaindene per mol of silver was added as a stabilizer to the emulsion without gold-sensitization to thereby obtain a mono-dispersed cubic silver iodobromide emulsion having a mean silver iodide content of 1.5 mol % and a mean grain size of 0.45 μm. The coefficient of variation thereof was 10%.

To each of the emulsions thus prepared was added the spectral sensitizing dye (a compound represented by formula (II) described above) of the present invention as shown in Table 2 below. Furthermore, to the emulsion were added 25 mg of 1 phenyl-5-mercaptotetrazole per mol of silver as an antifoggant, 150 mg/m² after coating of hydroquinone, 25% by weight based on the weight of the gelatin binder of a polyethyl acrylate latex as a plasticizer, the compound of formula (I) of this invention as shown in Table 2 below, 80 mg/m² after coating of 2-bis(vinylsulfonylacetamido)ethane as a hardening agent, and 40 mg/m² after coating of 2,4-dichloro-6-hydroxy-s-triazine. The resulting emulsion was coated on a polyester support at a silver coverage of 4.5 g/m². The gelatin coverage was 4.7 g/m².

On the emulsion layer were simultaneously formed a first protective layer and a second protective layer as in Example 1. In this case, however, 60 mg/m² of polymethyl methacrylate particles having a particle size of from 3 μm to 4 μm and 70 mg/m² of colloidal silica having a particle size of from 10 mμ to 20 mμ were used in place of the 200 mg/m² of the colloidal silica in the second protective layer.

In addition, each support employed had a back layer and a back protective layer of the following compositions.

| | |
|---|---|
| Back Layer: | |
| Gelatin | 3.9 g/m² |
| Sodium Dodecylbenzenesulfonate | 80 mg/m² |
| Dye (a) | 80 mg/m² |
| Dye (b) | 30 mg/m² |
| Dye (c) | 150 mg/m² |
| 1,3-Divinylsulfonyl-2-propanol | 80 mg/m² |
| Potassium Polyvinylbenzenesulfonate | 30 mg/m² |
| Back Protective Layer: | |
| Gelatin | 0.75 g/m² |
| Polymethyl Methacrylate Particles (particle size 4.7 μm) | 30 mg/m² |
| Sodium Dodecylbenzenesulfonate | 20 mg/m² |
| Fluorine Series Surface Active Agent (Compound (3) shown above) | 2 mg/m² |
| Silicone Oil | 100 mg/m² |

Dye (a)

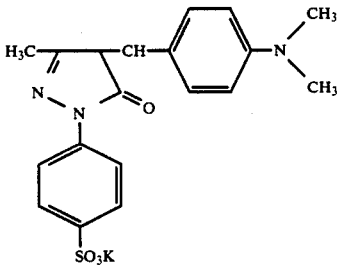

Dye (b)

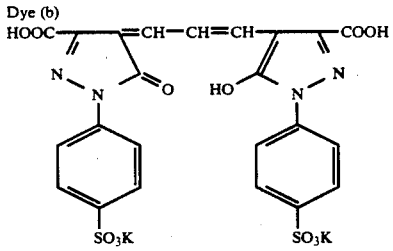

Dye (c)

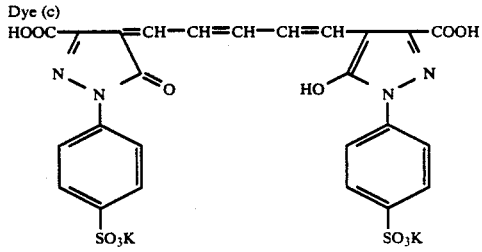

The sensitivity and the pressure resistance of each sample thus obtained were measured as in Example 1 and the results obtained are shown in Table 2 below.

TABLE 2

| Sample No. | Emulsion Type | Compound of Formula (II) Compound | Compound of Formula (II) Amount mg/mol-Ag | Compound of Formula (I) Compound | Compound of Formula (I) Amount mg/m$^2$ | Relative Sensivitivity | Pressure Resistance (ΔD) |
|---|---|---|---|---|---|---|---|
| 1 | A' | — | — | — | — | — | 0.7 |
| 2** | " | — | — | I-5 | 400 | — | 0.2 |
| 3 | B' | — | — | — | — | — | 0.2 |
| 4 | " | — | — | I-8 | 400 | — | 0.2 |
| 5 | A' | II-12 | 70 mg | — | — | 100 | 1.5 |
| 6** | " | " | " | I-5 | 200 | 100 | 0.6 |
| 7** | " | " | " | " | 400 | 98 | 0.4 |
| 8** | " | " | " | I-8 | 200 | 98 | 0.6 |
| 9** | " | " | " | " | 400 | 98 | 0.4 |
| 10 | B' | " | " | — | — | 16 | 0.4 |
| 11 | " | " | " | I-5 | 400 | 15 | 0.2 |
| 12 | " | " | " | I-8 | " | " | " |
| 13 | A' | II-12 | 70 mg | Comparison Compound (a)* | 400 | 98 | 1.5 |
| 14 | " | " | " | Comparison Compound (b)* | " | " | 1.7 |
| 15 | " | II-12<br>II-1 | 50<br>50 | — | — | 102 | 1.7 |
| 16** | " | " | " | I-5 | 400 | 100 | 0.5 |
| 17** | " | " | " | I-8 | " | 100 | 0.5 |
| 18 | " | " | " | Comparison Compound (a)* | " | 98 | 1.5 |
| 19 | " | " | " | Comparison Compound (b)* | " | 100 | 1.6 |

*Same as in Table 1
**Present Invention

As is clear from the results shown in Table 2, Samples 6 to 9 and 16 to 17 of this invention show good results for both relative sensitivity and pressure resistance as compared to the comparison examples. Sample 2 of this invention shows improved pressure resistance due to the addition of the compound of formula (I) though it has no improvement in relative sensitivity to light of 670 nm in wavelength because of the absence of the compound of formula (II).

EXAMPLE 4

To Emulsion A' as used in Example 3 was added the compound of the present invention shown by formula (III) described above. Furthermore after adding thereto 50 mg of 1-phenyl-5-mercaptotetrazole per mol of silver as an antifoggant, 200 mg of Compound (4) having the sturcture shown below, 150 mg/m$^2$ after coating of hydroquinone, 30% by weight based on the weight of the gelatin binder of a polyethyl acrylate latex, the compound of the present invention represented by formula (I) as shown in Table 3 below, and 100 mg/m$^2$ after coating of 2,4-dichloro-6 hydroxy-s-triazine as a hardening agent, the resultant emulsion was coated on a polyester support (as used in Example 3) at a silver converage of 4.3 g/m$^2$. The gelatin converage was 4.5/m$^2$.

On the emulsion layer was simultaneously coated the protective layers as in Example 3.

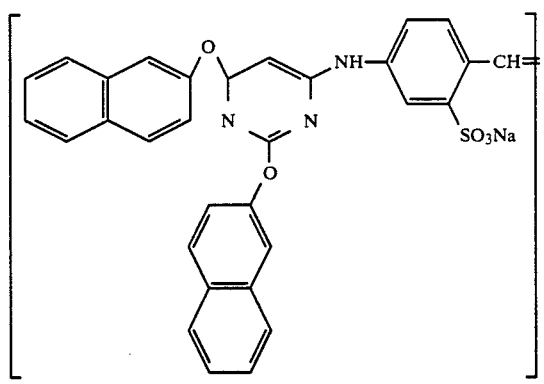

Each of the samples thus prepared were exposed to a xenon flash of $10^{-5}$ seconds through an interference filter having the peak at 633 nm and a continuous wedge. The samples were evaluated as in Example 3. The results obtained are shown in Table 3.

TABLE 3

| Sample No. | Compound of Formula (III) Compound | Compound of Formula (III) Amount (mg/mol-Ag) | Compound of Formula (I) Compound | Compound of Formula (I) Amount (mg/m$^2$) | R.S.** | P.R.*** |
|---|---|---|---|---|---|---|
| 1 | III-17 | 45 | — | — | 100 | 1.8 |
| 2 | " | " | I-8 | 400 | 100 | 0.7 |
| 3 | " | " | " | 500 | 95 | 0.3 |
| 4 | III-20 | " | — | — | 107 | 1.9 |
| 5 | " | " | I-8 | 400 | 105 | 0.6 |

TABLE 3-continued

| Sample No. | Compound of Formula (III) Compound | Amount (mg/mol-Ag) | Compound of Formula (I) Compound | Amount (mg/m²) | R.S.** | P.R.*** |
|---|---|---|---|---|---|---|
| 6 | " | " | " | 800 | 102 | 0.3 |
| 7 | " | " | I-9 | 400 | 107 | 0.5 |
| 8 | " | " | " | 800 | 105 | 0.3 |

**Relative Sensitivity
***Pressure Resistance
Sample Nos. 1 and 4: Comparative Samples
Sample Nos. 2, 3, and 5 to 8: Samples of the present Invention.

As is clear from the results shown above, Samples 2, 3, and 5 to 8 of this invention have very good pressure resistance and high sensitivity as compared to the comparative samples. That is, comparative samples 1 to 4 have a high sensitivity, but are inferior in pressure resistance.

EXAMPLE 5

Samples as in Example 3 described above were light-exposed as in Example 3, processed using a developer GR-Dl for Fuji Gradex and a fix solution GR-Fl for Fuji Gradex for 30 seconds at 34° C. in each step, and the photographic performance and the pressure resistance were likewise evaluated. The results show that Sample Nos. 6 to 9, 16, and 17 of the present Example are equivalent to the results of the corresponding samples of Example 3.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one hydrophilic colloid layer, at least one layer of which must be a gold- and sulfur-sensitized silver halide emulsion layer, said silver halide emulsion layer containing from 0.1 to 3.0 mol % silver iodide per mol of silver, wherein said silver halide emulsion comprises silver halide grains having a substantial core/shell structure wherein the silver iodide content in the shell is less than that in the core, and the silver halide emulsion layer or other hydrophilic colloid layer contains a polymer represented by formula (I);

$$-A)_x(B)_y(C)_z \quad (I)$$

wherein A represents a recurring unit derived from an ethylenically unsaturated monocarboxylic acid or a monocarboxylate thereof, capable of copolymerization with an ethylenically unsaturated monomer; B represents a recurring unit derived from a polyfunction cross-linking agent; C represents a recurring unit derived from an ethylenically unsaturated monomer, other than A and B; x represents the number of recurring unit A having a mole fraction of from 30 mol % to 100 mol %; y represents the number of recurring units B having a mole fraction of from 0 to 50 mol %; and z represents the number of recurring units C having a mole fraction of from 0 to 50 mol %, said silver halide emulsion further containing at least one compound represented by formula (II) or (III):

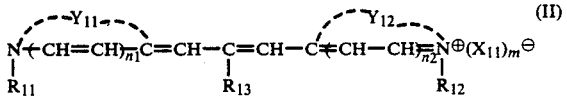

(II)

wherein $Y_{11}$ and $Y_{12}$ each represents a non-metallic atomic group which completes a heterocyclic ring selected from a benzothiazole ring, a benzoselenazole ring, a napthothiazole ring, a napthoselenzaole ring, and a quinoline ring; $R_{11}$ and $R_{12}$ each represents a lower alkyl group or an alkyl group having a sulfo group or a carboxy group; $R_{13}$ represents a lower alkyl group; $X_{11}$ represents an anion; $n_1$ and $n_2$ each represents 0 or 1; and m represents 0 or 1, and when the compound represented by the formula (II) forms an intramolecular salt, m is 0:

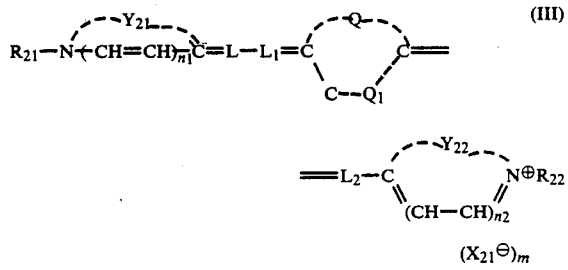

(III)

wherein $Y_{21}$ and $Y_{22}$ each represents a non-metallic atomic group which completes a 5- or 6-membered nitrogen-containing heterocyclic nucleus; $R_{21}$ and $R_{22}$ each represents an alkyl group, a substituted alkyl group, or an aryl group; Q and $Q_1$ represent non-metallic atomic groups which together complete a 4-thiazolidinone nucleus, a 5-thiazolidinone nucleus, or a 4-imidazolidinone nucleus; L, $L_1$, and $L_2$ each represents a methine group or a substituted methine group; $X_{21}$ represents an anion; and $n_1$, $n_2$, and m have the same meaning as defined for formula (II) above.

2. A silver halide photographic material as in claim 1, wherein the coefficient of variation of the silver halide grains having a substantial core/shell structure is not greater than 15%.

3. A silver halide photographic material as in claim 1, wherein the difference in the silver iodide content between the core and the shell is from 3 mol % to 15 mol %.

4. A silver halide photographic material as in claim 1, wherein the silver halide grains contain an iridium salt.

5. A silver halide photographic material as in claim 1, wherein the silver halide emulsion is spectrally sensitized by a sensitizing dye represented by the formula (II).

6. A silver halide photographic material as in claim 1, wherein the silver halide emulsion is spectrally sensitized by a sensitizing dye represented by formula (III).

7. A silver halide photographic material as in claim 1, wherein the silver halide emulsion is a monodisperse emulsion containing cubic or tetradecahedral silver halide grains.

8. A silver halide photographic material as in claim 1, wherein the mean silver iodide content of the silver halide grains having a substantial core/shell structure is from 0.5 mol % to 2.0 mol %.

9. A silver halide photographic material as in claim 1, wherein the photographic material contains a polyhydroxybenzene compound in at least one of the hydrophilic colloid layer(s).

* * * * *